US010635012B2

(12) United States Patent
Kashiwakura

(10) Patent No.: US 10,635,012 B2
(45) Date of Patent: Apr. 28, 2020

(54) IMAGE FORMING APPARATUS, IMAGE FORMING CONTROL METHOD AND STORAGE MEDIUM FOR DETECTING AN IMAGE DEFECT AND ENTERING A RECOVERY MODE

(71) Applicant: Konica Minolta, Inc., Tokyo (JP)

(72) Inventor: Kuniaki Kashiwakura, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/278,374

(22) Filed: Feb. 18, 2019

(65) Prior Publication Data

US 2019/0258187 A1 Aug. 22, 2019

(30) Foreign Application Priority Data

Feb. 20, 2018 (JP) ..... 2018-027510

(51) Int. Cl.
*G03G 15/01* (2006.01)
*G03G 15/043* (2006.01)
(Continued)

(52) U.S. Cl.
CPC ..... *G03G 15/0115* (2013.01); *G03G 15/0266* (2013.01); *G03G 15/043* (2013.01);
(Continued)

(58) Field of Classification Search
CPC ..... G03G 15/0115; G03G 15/043; G03G 15/5025; G03G 2215/00067;
(Continued)

(56) References Cited

U.S. PATENT DOCUMENTS

2002/0150831 A1* 10/2002 Ehara ..... G03G 5/08214 430/123.41
2006/0104653 A1* 5/2006 Yamamoto ..... G03G 15/5033 399/71
2015/0192884 A1 7/2015 Sone

FOREIGN PATENT DOCUMENTS

JP 2005074906 A 3/2005

OTHER PUBLICATIONS

Extended European Search Report dated Aug. 7, 2019, issued by the European Patent Office in corresponding European Application No. 19157621.4. (8 pages).

* cited by examiner

*Primary Examiner* — Joseph S Wong
(74) *Attorney, Agent, or Firm* — Buchanan Ingersoll & Rooney PC

(57) ABSTRACT

An image forming apparatus, including: an image former; and a hardware processor which detects a density of an image formed by the image former, controls the image former to continuously perform image formation on a predetermined number of sheets and thereafter form a plurality of types of halftone test images on a sheet, determines whether an image defect is generated and determines a factor causing the image defect by analyzing densities of the plurality of types of test images, executes a recovery mode which is set for each of the factor when the image defect is determined to be generated, and controls the image former to form a charged test image which is formed by the charger charging the surface of the image carrier and an uncharged test image which is formed without charging of the surface of the image carrier by the charger.

8 Claims, 9 Drawing Sheets

| | | TEST IMAGE 1 | TEST IMAGE 2 | TEST IMAGE 3 | MECHANISM |
|---|---|---|---|---|---|
| DEVELOPMENT | CHARGING | CHARGED | CHARGED | UNCHARGED | |
| | EXPOSURE | EXPOSED | UNEXPOSED | UNEXPOSED | |
| | DEVELOPING BIAS | NORMAL | HIGH | LOW | |
| LUBRICANT MEMORY | | NEGATIVE | NEGATIVE | NEGATIVE | NEUTRIZATION DIFFERENCE AT DEVELOPER DUE TO WHITE PORTION-SOLID PORTION LUBRICANT UNEVENNESS |
| PHOTORECEPTOR MEMORY | | NEGATIVE | — | — | DEEP HOLE TRAP OF SOLID PORTION, INCREASE OF SOLID PORTION SENSITIVITY |
| TRANSFER MEMORY | | NEGATIVE | NEGATIVE | — | SHALLOW HOLE TRAP OF WHITE PORTION, DECREASE OF WHITE PORTION SURFACE POTENTIAL |
| ACCUMULATION-TYPE TRANSFER MEMORY | | POSITIVE | — | — | DEEP HOLE TRAP OF WHITE PORTION, DESCREASE OF WHITE PORTION SENSITIVITY |
| CHARGING MEMORY | | POSITIVE | POSITIVE | — | CHARGING DEFECT DUE TO CONTAMINATION OF CHARGING DEVICE AT SOLID PORTION |

(51) Int. Cl.
*G03G 15/00* (2006.01)
*G03G 15/02* (2006.01)

(52) U.S. Cl.
CPC ..... *G03G 15/5025* (2013.01); *G03G 15/5062* (2013.01); *G03G 2215/00067* (2013.01)

(58) Field of Classification Search
CPC ..... G03G 15/0266; G03G 15/5062; G06T 7/0004; G06T 2207/3044
See application file for complete search history.

FIG. 5

| | | TEST IMAGE 1 | TEST IMAGE 2 | TEST IMAGE 3 | MECHANISM |
|---|---|---|---|---|---|
| DEVELOPMENT | CHARGING | CHARGED | CHARGED | UNCHARGED | |
| | EXPOSURE | EXPOSED | UNEXPOSED | UNEXPOSED | |
| | DEVELOPING BIAS | NORMAL | HIGH | LOW | |
| LUBRICANT MEMORY | | NEGATIVE | NEGATIVE | NEGATIVE | NEUTRIZATION DIFFERENCE AT DEVELOPER DUE TO WHITE PORTION-SOLID PORTION LUBRICANT UNEVENNESS |
| PHOTORECEPTOR MEMORY | | NEGATIVE | — | — | DEEP HOLE TRAP OF SOLID PORTION, INCREASE OF SOLID PORTION SENSITIVITY |
| TRANSFER MEMORY | | NEGATIVE | NEGATIVE | — | SHALLOW HOLE TRAP OF WHITE PORTION, DECREASE OF WHITE PORTION SURFACE POTENTIAL |
| ACCUMULATION-TYPE TRANSFER MEMORY | | POSITIVE | — | — | DEEP HOLE TRAP OF WHITE PORTION, DESCREASE OF WHITE PORTION SENSITIVITY |
| CHARGING MEMORY | | POSITIVE | POSITIVE | — | CHARGING DEFECT DUE TO CONTAMINATION OF CHARGING DEVICE AT SOLID PORTION |

IMAGE FORMING APPARATUS, IMAGE FORMING CONTROL METHOD AND STORAGE MEDIUM FOR DETECTING AN IMAGE DEFECT AND ENTERING A RECOVERY MODE

BACKGROUND

Technological Field

The present invention relates to an image forming apparatus, an image forming control method and a storage medium.

Description of the Related Art

There has been conventionally known an electrophotographic image forming apparatus which forms an electrostatic latent image by emitting (exposing) laser beams based on image data to a charged photoreceptor, forms a toner image by developing the formed electrostatic latent image with a toner, transfers the formed toner image onto a sheet, fixes the transferred toner image by heating with a fixer and thereby forms an image on the sheet.

Such an image forming apparatus generates image defects such as density irregularities of the output image in some cases. When an image defect occurs, a predetermined recovery mode is executed to solve the image defect.

For example, in the invention described in JP 2005-74906 (A), when an image defect occurs, a test pattern using an exposure device and a test pattern not using the exposure device are output, these output results are compared, thereby it is determined whether the image defect can be corrected by correcting the light amount of LED elements in the exposure device, and the light amount is corrected if it is determined that the image defect can be corrected. Thus, it is possible to solve the image defect due to the irregularities of light emission property of the LED elements, and perform control so that the correction is not excessively performed to image defects caused by other factors.

In an electrophotographic image forming apparatus, when an image such as a longitudinal band pattern is continuously printed and thereafter a halftone image is obtained, an image defect occurs at portions corresponding to the longitudinal bands in some cases. In detail, there are generated phenomenon such as a negative memory that the image density of the portions (solid history portions) corresponding to the longitudinal bands becomes lower than the image density of the surrounding portions (white history portions) and a positive memory that the image density of the solid history portions becomes higher than the image density of the white history portion.

Not only the cases where the negative memory and the positive memory are generated by different factors, but also the cases where the image defects are detected as same negative memories or positive memories include cases where the image defects are generated by different mechanisms actually. Though it is necessary to perform processing corresponding to the factors causing the image defects in order to surely solve these image defects, specifying the factors with a glance at the formed image is difficult. The invention described in JP 2005-74906 (A) hides the image defects by correcting the light exposure. However, since the factors causing the image defects are not determined, it is not possible to solve the image defects by performing processing corresponding to each of all the factors.

Accordingly, even for similar image defects, an analysis method capable of specifying the factors and a recovery method appropriate for each of the factors are required.

SUMMARY

The present invention has been made in consideration of the above problems, and an object of the present invention is to provide an image forming apparatus, an image forming control method and a program capable of recovering the image defects more desirably.

To achieve at least one of the abovementioned objects, according to a first aspect of the present invention, an image forming apparatus reflecting one aspect of the present invention includes: an image former which includes an image carrier that carries a toner image to be transferred onto a sheet, a charger that charges a surface of the image carrier, an exposer that performs exposure of the surface of the image carrier and a developer that develops the toner image on the image carrier; and a hardware processor which detects a density of an image formed by the image former, controls the image former to continuously perform image formation on a predetermined number of sheets and thereafter form a plurality of types of halftone test images on a sheet, determines whether an image defect is generated and determines a factor causing the image defect by analyzing detected densities of the plurality of types of test images, executes a recovery mode which is set for each of the factor causing the image defect when the image defect is determined to be generated, and controls the image former to form a charged test image which is formed by the charger charging the surface of the image carrier and an uncharged test image which is formed without charging of the surface of the image carrier by the charger.

According to a second aspect of the present invention, an image forming method reflecting one aspect of the present invention is an image forming control method in an image forming apparatus including an image former which includes an image carrier that carries a toner image to be transferred onto a sheet, a charger that charges a surface of the image carrier, an exposer that exposes the surface of the image carrier and a developer that develops the toner image on the image carrier, the method including: detecting a density of an image formed by the image former; controlling the image former to continuously perform image formation on a predetermined number of sheets and thereafter form a plurality of types of halftone test images on a sheet; determining whether an image defect is generated and determining a factor causing the image defect by analyzing detected densities of the plurality of types of test images; and executing a recovery mode which is set for each of the factor causing the image defect when the image defect is determined to be generated.

According to a third aspect of the present invention, a storage medium reflecting one aspect of the present invention is a non-transitory computer readable storage medium storing a program for causing a computer of an image forming apparatus to execute a following procedure, the image forming apparatus including an image former which includes an image carrier that carries a toner image to be transferred onto a sheet, a charger that charges a surface of the image carrier, an exposer that exposes the surface of the image carrier and a developer that develops the toner image on the image carrier, the procedure comprising: detecting a density of an image formed by the image former; controlling the image former to continuously perform image formation on a predetermined number of sheets and thereafter form a plurality of types of halftone test images on a sheet; determining whether an image defect is generated and determining a factor causing the image defect by analyzing detected densities of the plurality of types of test images; and executing a recovery mode which is set for each of the factor causing the image defect when the image defect is determined to be generated.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein:

FIG. 5 is a view for explaining printing conditions of test images;

DETAILED DESCRIPTION OF EMBODIMENTS

Hereinafter, one or more embodiments of the present invention will be described in detail with reference to the drawings. However, the scope of the invention is not limited to the disclosed embodiments.

[Configuration of Image Forming Apparatus]

Figure 1:
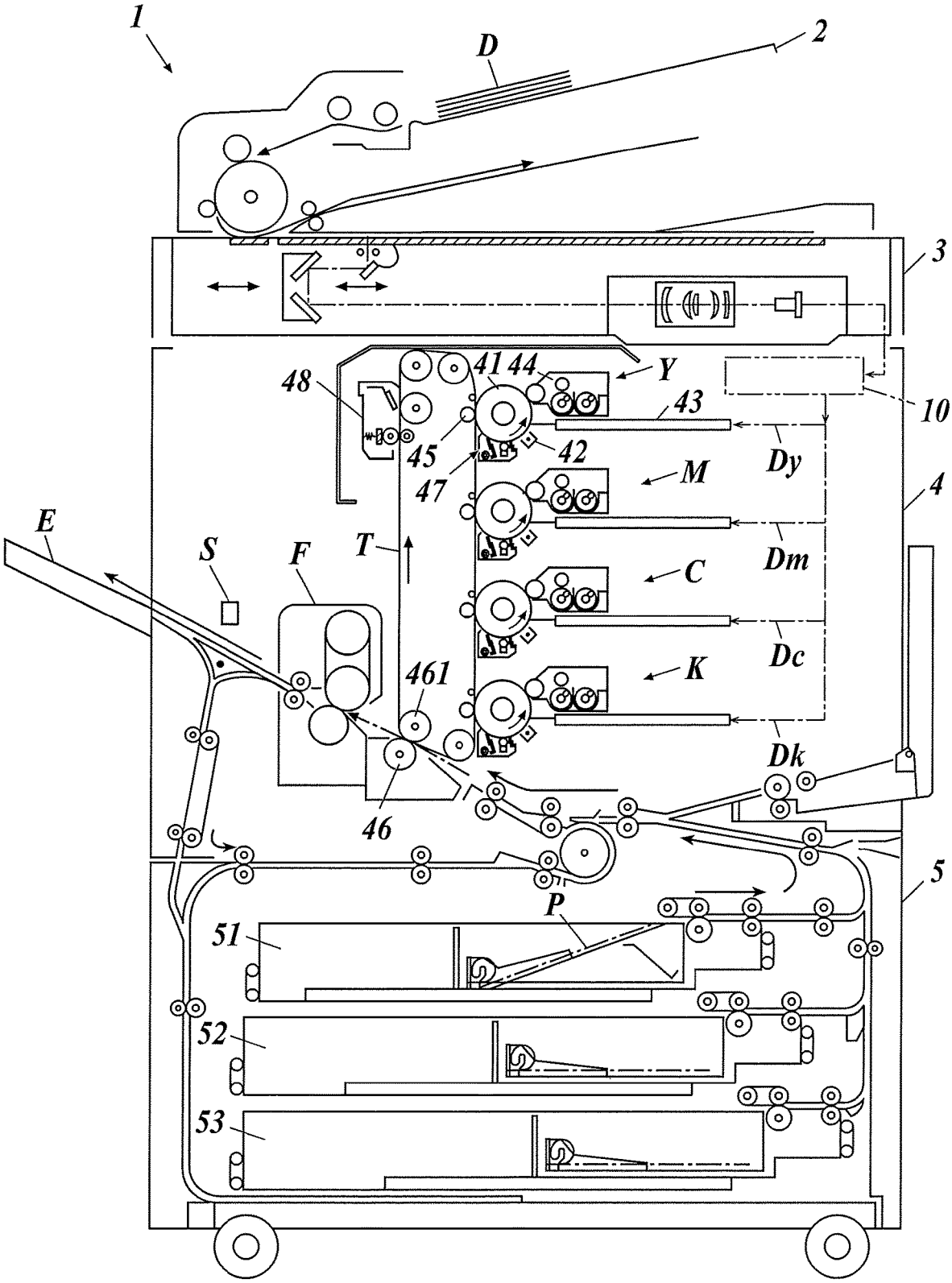
FIG. 1 is a view showing a schematic configuration of an image forming apparatus according to an embodiment.
Figure 2:
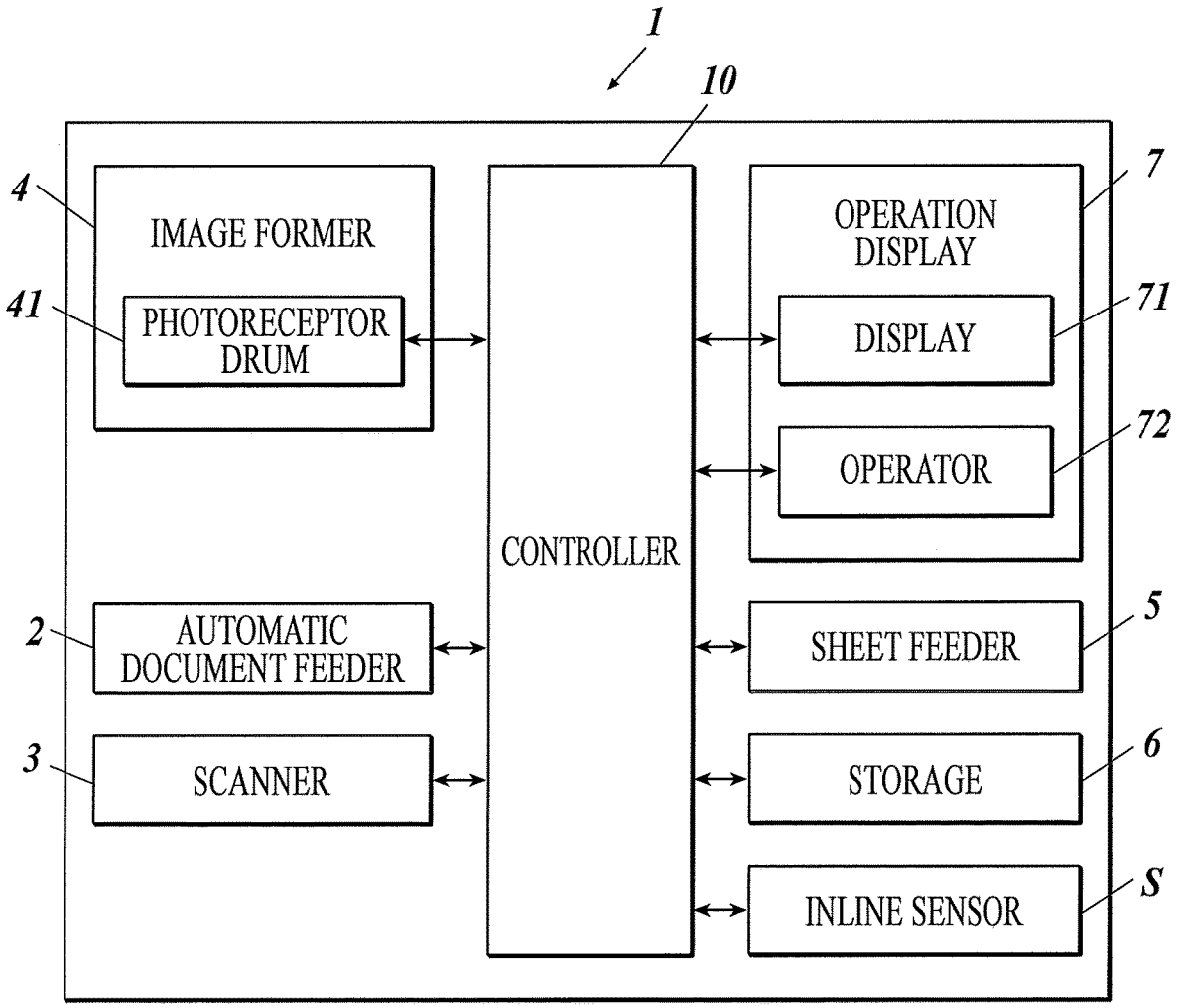
FIG. 2 is a block diagram showing a main functional configuration of the image forming apparatus according to the embodiment.
Figure 3:
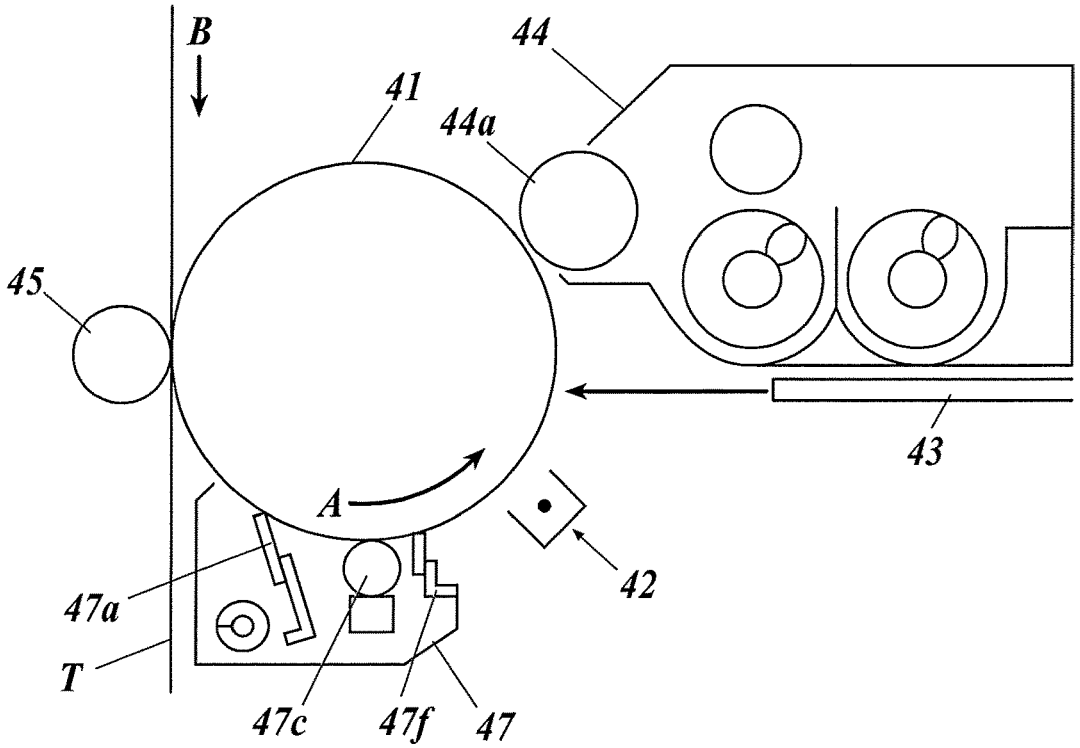
FIG. 3 is a view showing a schematic configuration of an image former.

The image forming apparatus 1 according to an embodiment is a color image forming apparatus of intermediate transfer type using the electrophotographic process technique. As shown in FIGS. 1 to 3, the image forming apparatus 1 is configured by including an automatic document feeder 2, a scanner 3, an image former 4, a sheet feeder 5, a storage 6, an operation display 7, a controller 10, an inline sensor S and the like.

The automatic document feeder 2 is configured by including a placement tray on which a document D is placed, a mechanism of conveying the document D, a conveyance roller and the like, and conveys the document D to a predetermined conveyance path.

The scanner 3 is configured by including an optical system such as a light source and a reflection mirror. The scanner 3 emits light to the document D conveyed through the predetermined conveyance path or the document D placed on the platen glass, and receives the reflected light. The scanner 3 converts the received reflected light into an electrical signal and outputs the signal to the controller 10.

The image former 4 is configured by including a yellow image former Y, a magenta image former M, a cyan image former C, a black image former K, an intermediate transfer belt T and a fixer F.

The image formers Y, M, C and K respectively form toner images of yellow, magenta, cyan and black on the photoreceptors 41, and primarily transfers the toner images of Y, M, C and K colors formed on the photoreceptors 41 onto the intermediate transfer belt T.

FIG. 3 is a view showing a schematic configuration of the image former 4. Each of the image formers Y, M, C and K includes a drum photoreceptor 41 (image carrier) which is rotated in A direction in FIG. 3, a charging device 42 (charger) which uniformly charges the surface of the photoreceptor 41, an exposure device 43 (exposer) which exposes the surface of the photoreceptor 41 charged by the charging device 42 to light and forms an electrostatic latent image, a developing device 44 (developer) which visualizes the electrostatic latent image formed by the exposure device 43 by using a developing agent including toners, a primary transfer roller 45 which transfers the toner image formed on the photoreceptor 41 onto the sheet, and a cleaner 47 which removes the toners on the photoreceptor 41 passing through the transfer region. Each of the image formers Y, M, C and K primarily transfers the toner image formed on the photoreceptor 41 onto the intermediate transfer belt T which moves in B direction in FIG. 3. The toner images transferred on the intermediate transfer belt T are transferred onto the sheet by the secondary transfer roller 46, thereafter conveyed to the fixer F and fixed onto the sheet.

Since the configurations and operations of the image formers Y, M, C and K are similar to each other, hereinafter, the yellow image former Y is taken as an example to describe a series of image forming operation performed by the image former 4.

The photoreceptor 41 is configured by an organic photoreceptor having a photosensitive layer formed of resin containing an organic photoconductor on the outer circumference surface of a metal base in a drum shape. The photoreceptor 41 is rotated in the direction of A in FIG. 3. As a resin forming the photosensitive layer, for example, there can be used polycarbonate resin, silicone resin, polystyrene resin, acrylic resin, methacrylate resin, epoxy resin, polyurethane resin, polyvinyl chloride resin, melamine resin and the like.

The photoreceptor 41 has a layer structure in which an under coat layer (UCL), a charge generation layer (CGL) and a charge transport layer (CTL) are arranged in this order on a conductive tube such as an aluminum tube.

The charging device 42 charges the photoreceptor 41 to a fixed potential with a negative polarity by using the charger.

The exposure device 43 removes charges of the portion which was exposed by exposing the non-image region of the photoreceptor 41 on the basis of image data Dy from the controller 10, and forms an electrostatic latent image in the image region of the photoreceptor 41.

In detail, when the charges are removed by exposing, with the exposure device 43, the surface of the photoreceptor 41 which is charged to negative polarity by the charging device 42 and both of positive and negative charges are generated in the charge generation material (CGM) in CGL, the positive charges (holes) pass the CTL and reaches the surface of photoreceptor 41, the negative charge passes UCL and reaches the tube, and thereby the electrostatic latent image is formed on the surface of the photoreceptor 41.

The developing device 44 includes a developing sleeve 44*a* arranged so as to face the photoreceptor 41 via the developing region. The developing bias of superposing an AC voltage on a DC voltage of a same polarity as the charging polarity of the charging device 42, that is, the negative polarity, for example, is applied to the developing sleeve 44*a*. Thus, the developing agent is supplied to the electrostatic latent image formed on the photoreceptor 41, and a yellow toner image is formed on the photoreceptor 41. The developing agent contains toners and carriers for charging the toners.

The toner is not especially limited, and known toners which are generally used can be used. For example, there can be used a toner which is obtained by containing a coloring agent and, as needed, a charging control agent, a releasing agent or the like in a binder resin and processing an external additive agent. Though the toner particle size is not especially limited, 3 to 15 μm is preferable.

The primary transfer roller 45 primarily transfers the yellow toner image formed on the photoreceptor 41 onto the intermediate transfer belt T. As for the other image formers M, C and K, the toner images of magenta, cyan and black are primarily transferred onto the intermediate transfer belt T. Thus, the color toner images of Y, M, C and K are formed on the intermediate transfer belt T.

The intermediate transfer belt T is a semiconductive endless belt which is put over a plurality of rollers and supported so as to be rotatable, and the intermediate transfer belt T is rotated in the direction of B in the figure according to the rotation of the rollers. The intermediate transfer belt T is pressed by the primary transfer rollers 45 against the respective facing photoreceptors 41. Transfer current corresponding to the applied voltage flows in each of the primary transfer rollers 45. Thus, the toner images which are developed on the surfaces of the respective photoreceptors 41 are primarily transferred onto the intermediate transfer belt T sequentially by the respective primary transfer rollers 45.

The secondary transfer roller 46 is pressed by the intermediate transfer belt T, driven to rotate, and thereby secondarily transfers the toner images of Y, M, C and K colors which were transferred and formed on the intermediate transfer belt T onto the sheet P which was conveyed from any of sheet feeding trays 51 to 53 of the sheet feeder 5. In detail, the secondary transfer roller 46 is arranged to contact the secondary transfer facing roller 461 via the intermediate transfer belt T and the sheet P passes the transfer nip formed between the secondary transfer roller 46 and the secondary transfer facing roller 461. Thereby, the toner images on the intermediate transfer belt T are secondarily transferred onto the sheet P.

The toners which were not transferred onto the intermediate transfer belt T in the transfer region and remain on the photoreceptors 41 are conveyed to the cleaners 47, and collected by the cleaners 47.

The photoreceptors 41 for which the toners on the surface thereof were collected by the cleaners 47 are charged again by the charging devices 42, and repeat the process of forming the next electrostatic latent images and forming the toner images.

Figure 4:
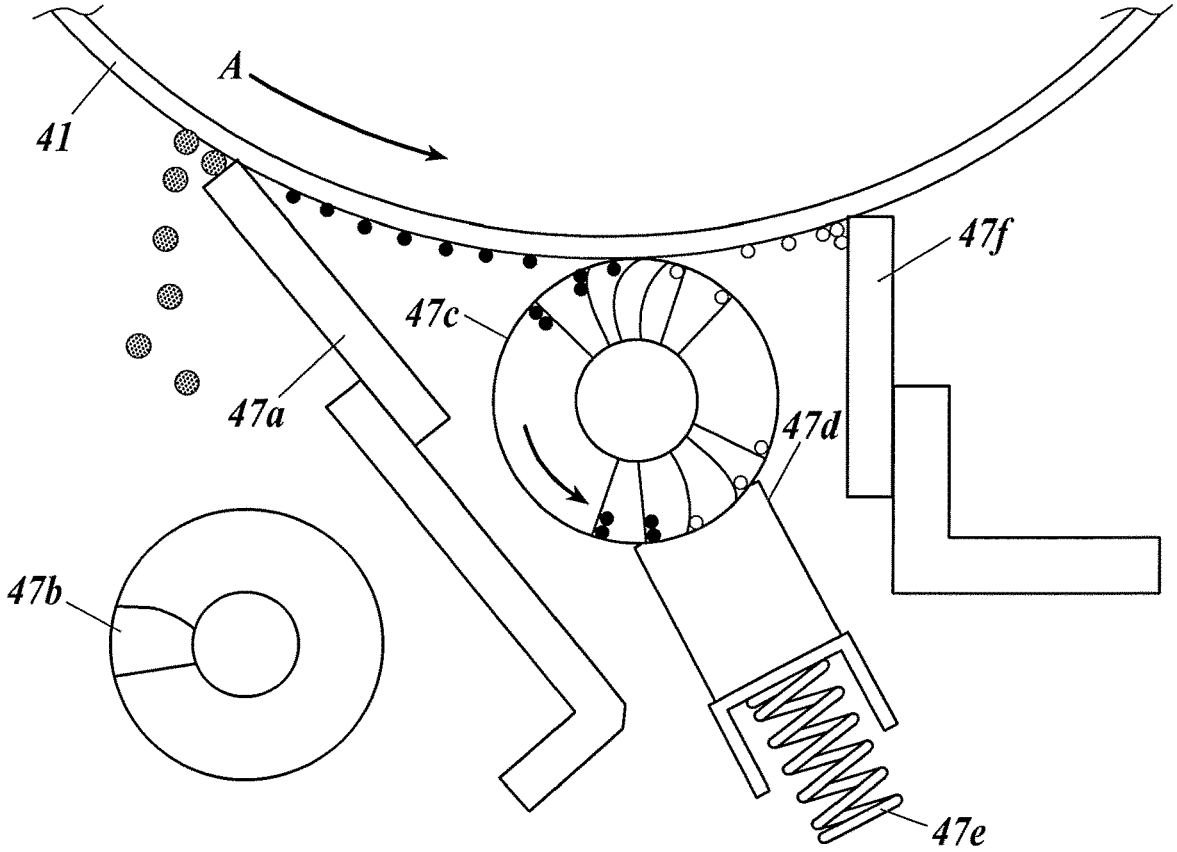
FIG. 4 is a view showing a schematic configuration of a cleaner.

FIG. 4 is a schematic view showing the configuration of the cleaner 47.

As shown in FIG. 4, the cleaner 47 includes a cleaning blade 47*a*, a collection screw 47*b* which is provided in the nearly lower side of the cleaning blade 47*a*, an application roller 47*c* which is provided in the downstream side in the rotation direction of the photoreceptor 41 with respect to the cleaning blade 47*a*, a lubricant bar 47*d* for supplying the lubricant agent to the application roller 47*c*, a presser 47*e* which presses and holds the lubricant bar 47*d* against the application roller 47*c*, and a fixation blade 47*f* which is provided in the downstream side in the rotation direction of the photoreceptor 41 with respect to the application roller 47*c*.

The cleaning blade 47*a* is obtained by, for example, processing an elastic body such as polyurethane rubber to be a flat plate, the tip of the cleaning blade 47*a* is set to scrape the photoreceptor 41, and the cleaning blade 47*a* scrapes and removes the attached substances such as toners which were not transferred and remain on the surface of the photoreceptor 41.

The external additive agents which were conveyed together with the toners constantly slip through the nip section between the cleaning blade 47*a* and the photoreceptor 41. Though the external additive agents which slipped through the nip section are partially collected by the application roller 47*c*, the external additive agents which were not collected contaminate the charging device 42 and the like in some cases.

The collection screw 47*b* is rotated in one direction, and conveys the toners, which were scraped off by the cleaning blade 47*a* and dropped, to a waste tonner box not shown in the drawings.

The application roller 47*c* is a roll brush member which is arranged at the position which enables the tip thereof to contact the photoreceptor 41. Under control by the controller 10, the application roller 47*c* rotates so as to have a linear speed lower than that of the photoreceptor 41 by performing the counter rotation of moving the surface in the opposite direction to the movement direction of the surface of the photoreceptor 41 at the contact point contacting the photoreceptor 41.

The lubricant bar 47*d* is obtained by, for example, solidifying a lubricant agent of metallic soap powders such as zinc stearate by melting and shaping. The lubricant bar 47*d* is arranged at a position able to contact the tip of the application roller 47*c*, and the lubricant bar 47*d* is scraped off from the tip by the rotation of the application roller 47*c*. The scraped lubricant agent is directly conveyed to the photoreceptor 41 and supplied to the surface of the photoreceptor 41.

The presser 47*e* includes a compression spring which forces the lubricant bar 47*d* toward the direction of the application roller 47*c*, and presses and holds the lubricant bar 47*d* against the application roller 47*c*.

The fixation blade 47*f* is obtained by, for example, processing an elastic body such as polyurethane rubber to be a flat plate, similarly to the cleaning blade 47*a*. The fixation blade 47*f* contacts the surface of the photoreceptor 41 in the direction of trailing the surface of the photoreceptor 41 (trailing contact), and the tip thereof is set to scrape the photoreceptor 41.

The fixation blade 47*f* spreads the powders of the lubricant agent supplied to the surface of the photoreceptor 41, and forms a film on the surface of the photoreceptor 41 to form a film (lubricant layer). The lubricant layer formed of zinc stearate has a feature of a high release property (high pure water contact angle) and a small frictional coefficient. Thus, the transferring property and the cleaning property are good and the wearing of the photoreceptor 41 is suppressed, which achieves a long life.

The image former 4 heats and pressurizes, with the fixer F, the sheet P on which the toner images of Y, M, C and K colors are secondarily transferred, and thereafter ejects the sheet P outside the apparatus through a predetermined conveyance path.

These are a series of image forming operation by the image former 4.

The inline sensor S is arranged in the downstream side of the fixer F in the sheet conveyance direction. The inline sensor S reads the image printed on the sheet P by using an image sensor such as a CCD during passage of the sheet P, and obtains image information for correcting the image density at the time of image formation and making the conditions of image formation appropriate.

The sheet feeder 5 is configured by including a plurality of sheet feeding trays 51 to 53, and contains a plurality of sheets P of different types in respective sheet feeding trays 51 to 53. The sheet feeder 5 feeds the sheet P contained via a predetermined conveyance path to the image former 4.

The storage 6 is configured by including an HDD (Hard Disk Drive), a semiconductor memory and the like, and stores data such as program data and various types of setting data so as to be readable and writable by the controller 10.

The operation display 7 is configured by including a liquid crystal display (LCD) with a touch panel, for example, and functions as a display 71 and an operator 72.

The display 71 displays various types of operation screens, operation states of respective functions and the like in accordance with the display control signal input from the controller 10. The display 71 receives a touch operation by the user and outputs the operation signal to the controller 10.

The operator 72 includes various operation keys such as numerical keys and a start key, receives various input operations by the user and outputs the operation signal to the controller 10. By operating the operation display 7, the user can perform the setting regarding image formation such as image quality setting, rate setting, application setting, output setting and sheet setting, the instruction to convey the sheet, the operation to stop the device, and the like.

The controller 10 is configured by including a CPU, a RAM, a ROM and the like. The CPU loads various programs stored in ROM into RAM, and cooperates with the loaded various programs to integrally control the operations of the respective components in the image forming apparatus 1 such as the automatic document feeder 2, the scanner 3, the image former 4, the sheet feeder 5, the storage 6, the operation display 7 and the inline sensor S (see FIG. 2). For example, the controller 10 inputs an electrical signal from the scanner 3 to perform various types of image processing, and outputs image data Dy, Dm, Dc and Dk of respective colors Y, M, C and K generated in the image processing to the image former 4. The controller 10 controls the operation of the image former 4 to form a test image on the sheet.

[Factor Causing Image Defect]

Next, memory images generated by continuous printing and the factors causing the memory images will be described.

For example, after continuous printing of the longitudinal band image extending in the sheet feeding direction, when a halftone image which is uniform over the entire surface is obtained, image defects such as a negative memory and a positive memory are generated. The negative memory indicates the defect that the image density of the portion (solid history portion) corresponding to the longitudinal band in the continuous printed image is lower than that of the portion (white history portion) surrounding the longitudinal band. The positive memory indicates the defect that the image density of the portion (solid history portion) corresponding to the longitudinal band is higher than that of the surrounding portion (white history portion).

The negative memory will be described in detail. As the negative memory, there are a negative memory which is generated due to the density of solid history portion becoming lower than that of the white history portion and a negative memory which is generated due to the density of the white history portion becoming higher than that of the surrounding portion. However, both of them are detected as a same negative memory in the halftone image. There is a photoreceptor memory as the negative memory having a lower density of the solid history portion. There are a transfer memory and a lubricant memory as the negative memory having a higher density of the white history portion.

The photoreceptor memory will be described. When the function of CTM is lowered due to the continuous exposure at the time of continuous printing, the carriers (holes) generated by the exposure are trapped at CGL or the interface between CGL and CTL. As a result, since the electric field applied to CGL is reduced, the generation of carrier pair is suppressed or recombination easily occurs. That is, the photoreceptor memory is a phenomenon that the density of the solid history portion is lowered due to the decrease in sensitivity of solid history portion in the surface of the photoreceptor 41.

The transfer memory will be described. When the photoreceptor 41 is subjected to discharge of positive charges from the intermediate transfer belt T, the positive charges are trapped in the very shallow portion in CTL, the trapped positive charges are ejected after the next charging step to cancel the negative charges, and as a result, the potential of the surface of the photoreceptor 41 is lowered. The white history portion has a large potential difference from the intermediate transfer belt T since exposure is not performed, and the toners do not intervene. Thus, the white history portion is easily subjected to the positive discharge from the intermediate transfer belt T. That is, the transfer memory is a phenomenon that the density of the white history portion becomes higher due to the decrease in potential of the white history portion in the surface of the photoreceptor 41.

The lubricant memory will be described. The lubricant amount applied on the photoreceptor 41 is different between the white history portion and the solid history portion, and the white history portion has a larger lubricant amount than that of the solid history portion. This is because the action of scraping the lubricant layer on the photoreceptor 41 with the cleaning blade 47*a* is high since a large amount of toners is supplied to the solid portion. As the lubricant agent, zinc stearate is mainly used. As for the zinc stearate and acrylic resin which is the toner base, triboelectric series are relatively apart from each other, and zinc stearate is positioned on the positive polarity side. By the photoreceptor 41 rubbing the toners at the developing device 44, the lubricant layer is frictionally charged to the positive polarity side. That is, there is an action of neutralizing the surface potential (negative polarity) of the photoreceptor 41. In other words, the lubricant memory is a phenomenon that the white history portion has a higher image density than that of the solid history portion when the halftone image is obtained since the developed amount is increased by the neutralization.

The positive memory will be described. As the positive memory, there are a positive memory which is generated due to the density of solid history portion being higher than the white history portion and a positive memory which is generated due to the density of the white history portion being lower than the solid history portion. However, both of them are detected as a same positive memory in the halftone image. There is a charging memory as the positive memory in which the density of the solid history portion is higher than that of the white history portion. There is an accumulation-type transfer memory in which the density of the white history portion is lower than that of the solid history portion.

The charging memory will be described. As for the solid history portion, since the toners constantly enter the cleaning blade 47*a*, the external additive agent detached from the toners or the toners themselves slip through the cleaning blade 47*a* though the amount may be small. As a result, since the charging device 42 contacting the solid history portion is contaminated and lowers the charging capacity and the surface potential of the solid history portion is lowered, the charging memory is generated due to the increase in density.

The accumulation-type transfer memory will be described. The accumulation-type transfer memory is the aggravated transfer memory. The positive charges received by discharge from the intermediate transfer belt T are trapped around a deep portion of CTL or interface between CTL and CGL. The electric field applied to CGL is decreased by this trap. Thus, generation of carrier pair is suppressed or recombination easily occurs, and the sensitivity of the surface of the photoreceptor 41 is lowered. The accumulation-type transfer memory is generated by the sensitivity of white history portion being lowered and the density of the white history portion being lowered since the white history portion is easily subjected to discharge from the intermediate transfer belt T than the solid history portion.

[Recovery Method of Image Defect]

Next, in order to solve the memories generated by continuous printing, recovery methods effective for respective types will be described.

The recovery method when the photoreceptor memory is generated will be described.

Since the photoreceptor memory is mainly caused by hole trap at the deep portion of the solid history portion, it is necessary to release the trapped holes. As described above, the holes are trapped at CGL or the interface between CGL and CTL. The film thickness of CTL is normally approximately 20 μm, and the film thickness of CGL and UCL is approximately 2 to 3 μm. Thus, it is more efficient to move the holes to the grounded tube side than to move the holes to the direction of surface of the photoreceptor 41. Thus, the electric field toward the tube side from the surface of the photoreceptor 41 is formed, and the trapped holes are induced into the tube side. In detail, there is provided a photoreceptor memory recovery mode of pressing the intermediate transfer belt T and applying the transfer voltage to drive for a fixed time.

The recovery method when the transfer memory is generated will be described.

Since the transfer memory is mainly caused by the hole trap at the shallow portion of the white history portion, it is necessary to release the trapped holes. Since the trap is at the shallow portion, movement to the direction of the surface of the photoreceptor 41 is highly efficient. Thus, an electric field toward the surface of the photoreceptor 41 from the tube side is formed and the holes are induced to the direction of the surface of the photoreceptor 41. In detail, there is provided a transfer memory recovery mode of not pressing the intermediate transfer belt T but driving for a fixed time in a state in which the surface potential is applied to the photoreceptor 41.

The recovery method when the lubricant memory is generated will be described.

Since the lubricant memory is a phenomenon caused by irregularities in the lubricant agent application amount on the photoreceptor 41, it is necessary to make the application amount uniform. The most efficient method for making the application amount uniform is to perform application after deleting the lubricant layer. By sending the toners to the entire region of the cleaning blade 47*a*, the lubricant layer can be deleted by the polishing effect. The deletion speed can be higher as a larger amount of toners are sent. Since the deletion speed is raised by decreasing supply of the lubricant agent, it is desirable to set the number of rotation of the application roller 47*c* to minimum, and to set the lubricant agent pressing load by the presser 47*e* to low. In detail, there is provided a lubricant memory recovery mode of not pressing the intermediate transfer belt T and developing the toners and driving for a fixed time. In a case where the charging device 42 is an AC charging roller, when the AC voltage (Vpp) is set to high, the lubricant layer is deteriorated and becomes easy to polish, and it is possible to increase the deletion speed more.

The recovery method when the charging memory is generated will be described.

Since the charging memory is mainly caused by the charging defect in accordance with the contamination of the charging device 42, it is necessary to clean the charging device 42 or raise the charging capacity.

As for cleaning of the charging device 42, if the image forming apparatus 1 has a cleaning mechanism, the cleaning is executed as the charging memory recovery mode.

In a case of raising the charging capacity, it is assumed to raise the electric current or voltage applied to the charging device 42. In the embodiment, since the charging device 42 is scorotron type, the charging capacity is improved by raising the electric current applied to the wire. If the charging device 42 is a charging roller, the AC voltage (Vpp) is set to high. It is preferable to display a message urging the user to exchange the charging device 42.

The recovery method when the accumulation-type transfer memory is generated will be described.

Since the accumulation-type transfer memory is mainly caused by the hole trap at the deep portion of the white history portion, it is necessary to release the trapped holes. As described above, the holes are trapped at CGL or the interface between CGL and CTL. Since a relatively large number of holes are trapped, it is effective to apply oscillating electric field to excite the trapped holes and delete the holes, not forming the electric field to eject the holes. If the intermediate transfer belt T is pressed and the electric field is formed to move the holes, more positive charges are injected and the memory will possibly become worse. Thus, it is effective to delete the holes.

In detail, there is provided an accumulation-type charging memory recovery mode of not pressing the intermediate transfer belt T so as to prevent the injection of positive electric charges caused by discharge, and applying an AC voltage of developing bias with the developing device 44 to drive for a fixed time. If the charging device 42 is an AC charging roller, the AC electric field may be applied by the AC voltage. It is effective to apply AC voltage of a value larger than the setting value at the normal time by the charging device 42 only at the time of accumulation-type charging memory recovery mode.

[Determination Method of Factor Causing Image Defect]

Next, the determination method of the factor causing the memory image will be described by using FIGS. 5 and 6.

In the embodiment, the factor is determined by outputting the halftone image in which the entire surface is uniform as a test image, and detecting the memory generation state of the image. As the test image, the following three patterns with different printing conditions are prepared.

FIG. 5 shows the relation between the printing condition of each test image and whether the image memory was generated or not. FIG. 6 schematically shows whether the image memory was generated or not for each of the factors when each test image is obtained.

As test image 1, a halftone image is output on the entire surface under the image forming condition which has been used until the last printing. The continuous printed image until the last printing is an image which has a plurality of solid longitudinal band patterns being printed as shown in FIG. 6. That is, when the test image 1 is obtained, as shown in FIG. 5, the surface of the photoreceptor 41 is charged by the charging device 42 and exposed by the exposing device 43. The developing bias by the developing device 44 is set to be a same value as that of normal image formation.

The negative memory and the positive memory can be determined by comparing the image with the image pattern until the last printing. In detail, the controller 10 determines the negative memory or the positive memory when the difference in density between the solid history portion and the white history portion of the continuous printed image exceeds a preset threshold. Thus, as shown in FIGS. 5 and 6, it is possible to determine the photoreceptor memory, the transfer memory and the lubricant memory which are the negative memory, and the charging memory and the accumulation-type transfer memory which are the positive memory.

As the test image 2, as shown in FIG. 5, a halftone image is obtained by setting the developing bias to be higher than the surface potential of the photoreceptor 41 in a state in which the charged photoreceptor 41 is not exposed. Since the photoreceptor 41 is not exposed, whether the defects are caused by the influence of change in sensitivity of the photoreceptor 41 or by the influence of the charging potential can be distinguished. In the test image 2, the memory caused by the change in sensitivity is not detected.

Figure 6:
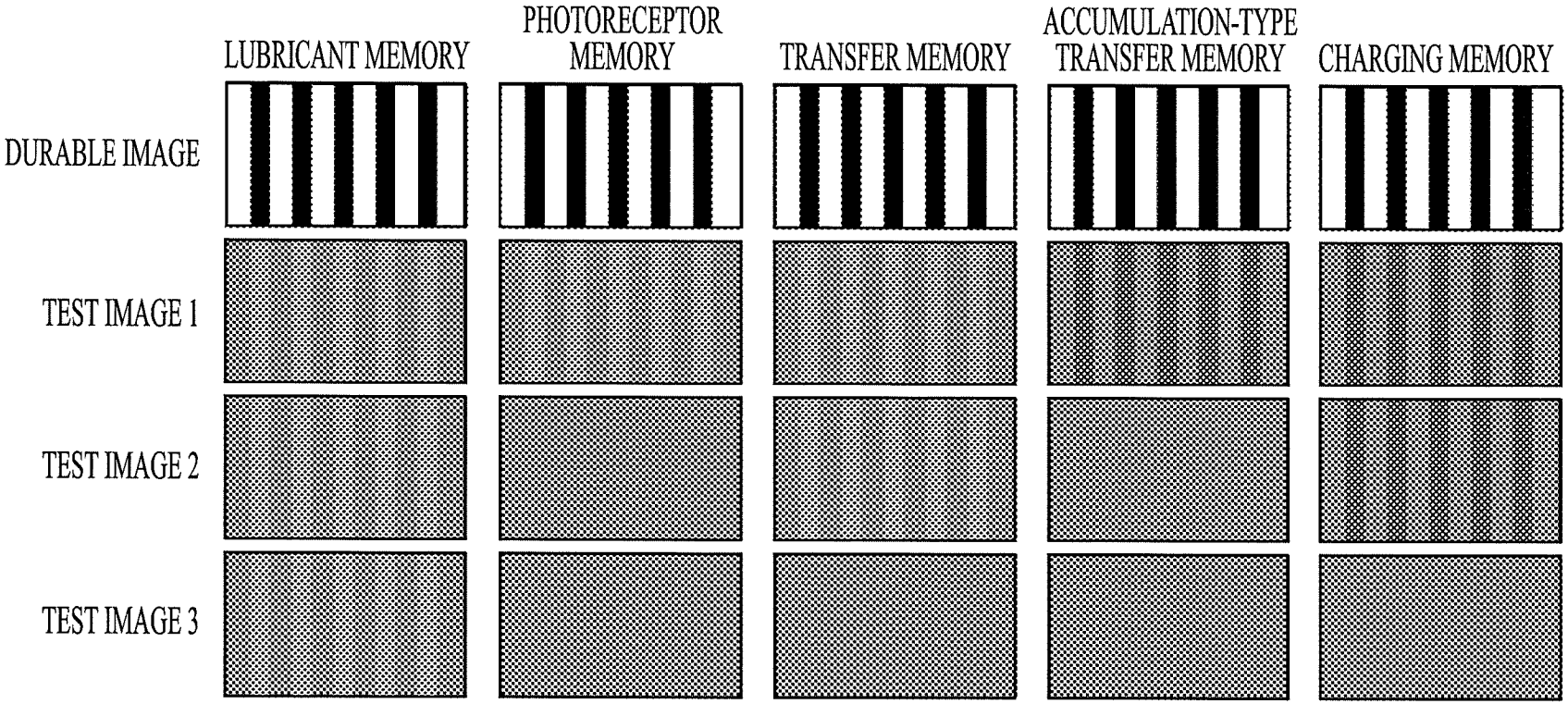
FIG. 6 is a view for explaining the test image obtained for each factor of an image memory.

That is, as shown in FIGS. 5 and 6, the defect is determined to be the photoreceptor memory if the test image 1 has the negative memory and the memory disappears in the test image 2. On the other hand, when the defect is the lubricant memory or the transfer memory, the negative memory is generated also in the test image 2. If the test image 1 has a positive memory and the memory disappears in the test image 2, the defect is considered to be the accumulation-type transfer memory. That is, it is possible to determine the positive memory by comparing the test image 1 with the test image 2.

As the test image 3, as shown in FIG. 5, a halftone image is obtained by setting the developing bias to be lower than the surface potential of the photoreceptor 41 in a state in which the photoreceptor 41 is not charged and not exposed. Since the photoreceptor 41 is not charged, it is possible to determine whether the defect is caused by the influence of the charging potential or not.

That is, as shown in FIGS. 5 and 6, the defect is considered to be the lubricant memory generated by frictional charging between the lubricant layer of the surface of the photoreceptor 41 and the developing device 44 if the test image 1 has a negative memory and the test image 3 also has the memory. That is, it is possible to determine the negative memory by comparing the test image 2 with the test image 3.

In FIG. 5, though the test image 3 is printed in the unexposed state, the similar result is obtained even if the printing is performed in the exposed state.

Figure 7:
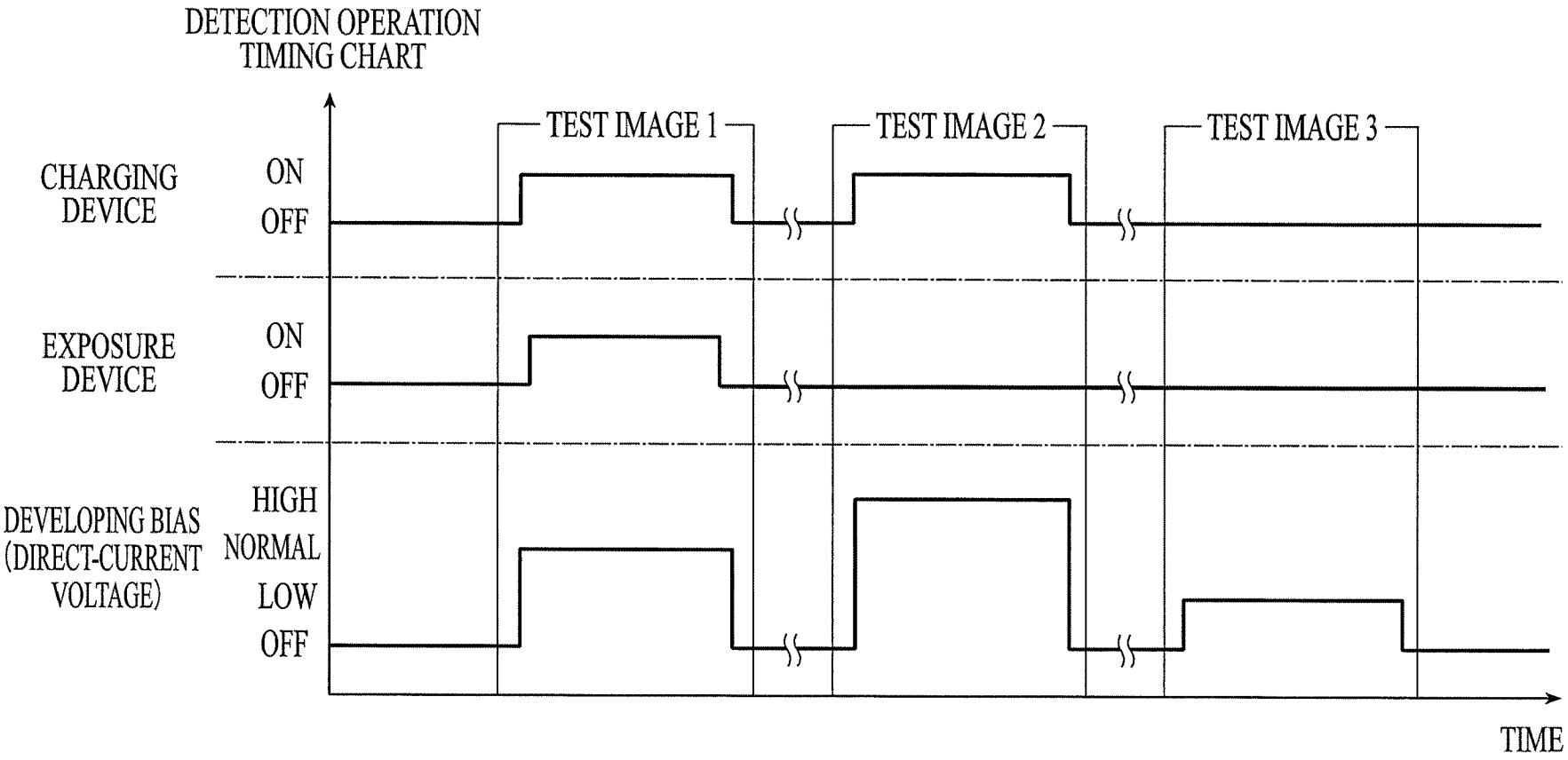
FIG. 7 is a timing chart of an operation of the image forming apparatus when the test images are obtained.

The operations of the charging device 42, the exposure device 43 and the developing device 44 at the time of obtaining each of the test images will be described by using the timing chart in FIG. 7.

The determination operation is executed after the continuous printing is continued for a predetermined number of sheets. The determination operation may be executed after continuous printing is finished or may be executed by interrupting the printing operation during the printing. Though a relatively large number of sheets such as 1000 sheets, for example, are appropriate as the predetermined number of sheets of the continuous printing, the predetermined number of sheets may be less depending on the environment (low temperature low humidity, high temperature high humidity) or the like during the printing.

Though the test image 1 is printed under a same printing condition as that of the last printing operation, the test image 1 may be printed under a preset printing condition.

The exposure is performed under a condition enabling acquisition of a halftone image in which the entire surface is uniform, and the exposure may be performed by halftone dots as in the normal image formation or by continuous tone. Since the memory is generally emphasized in the halftone image by the continuous tone, this surely prevents the image memory. However, there is a concern that the recovery mode is executed even to the memory of unnoticeable level, leading to the bad productivity.

In the embodiment, the test image 1 is obtained under the following condition.

The applied voltage of the charging device 42 is controlled so that the surface potential of the photoreceptor 41 is −600V, and the developing bias (DC voltage) by the developing device 44 is −450V. The exposure is the halftone exposure by the halftone dots, and the exposure amount is adjusted so that the average surface potential is −350V. That is, the potential difference (developing potential difference) for developing is 100V.

The test image 2 is obtained under the following condition.

Similarly to the test image 1, the charging device 42 is controlled, and the surface potential of the photoreceptor 41 is −600V. Since the exposure device 43 is in an off state, the developing bias is set to −700V so that the developing potential difference is 100V which is same as the test image 1. Thus, the halftone image in which the entire surface is uniform can be obtained. Since the exposure is not performed, the image will be the halftone image as in the continuous tone if the image defects are not generated.

The test image 3 is obtained under the following condition.

The halftone is output in a state in which both of the charging device 42 and the exposure device 43 are in an off state. Since the surface potential of the photoreceptor 41 is nearly 0V, the developing bias is set to −100V so that the developing potential difference is 100V.

After each of the test images is output, the test image is detected by the inline sensor S, the detected image is analyzed by the controller 10 and thereafter the recovery mode to be executed is determined.

The test image is ejected to a tray different from a normal sheet ejection tray or is stocked inside the image forming apparatus 1. Depending on the analysis result, it is possible to determine the factor causing the image memory without outputting the test image 2 and the following test image 3 or without outputting the test image 3. Thus, these test images are not output in some cases. Though three types of test image are printed on individual sheets in the embodiment, a single sheet may be divided into three to output the test images.

Figure 9:
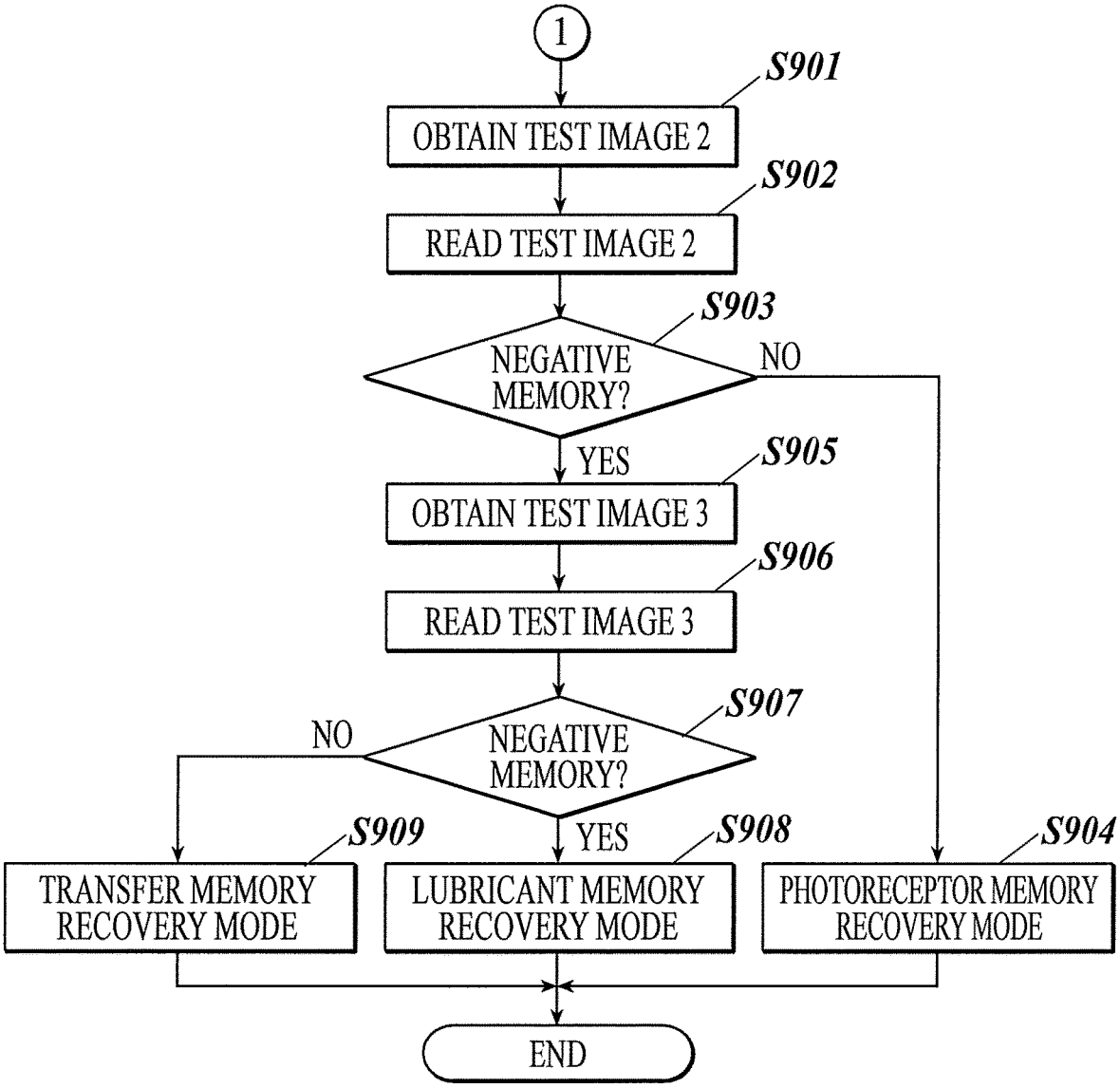
FIG. 9 is a flowchart showing an operation of the image forming apparatus when a negative memory is generated.
Figure 10:
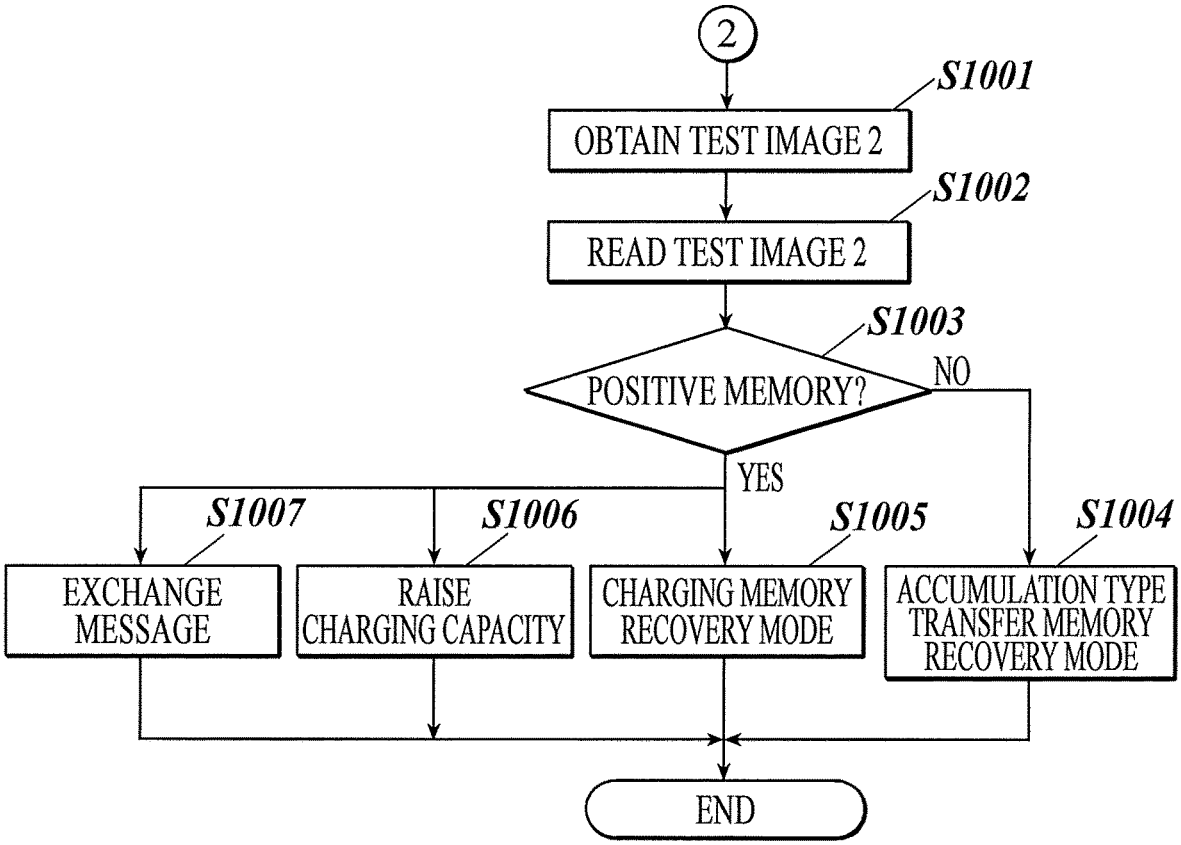
FIG. 10 is a flowchart showing an operation of the image forming apparatus when a positive memory is generated.

By using the flowcharts in FIGS. 8 to 10, the operation of the image forming apparatus 1 will be described.

Figure 8:
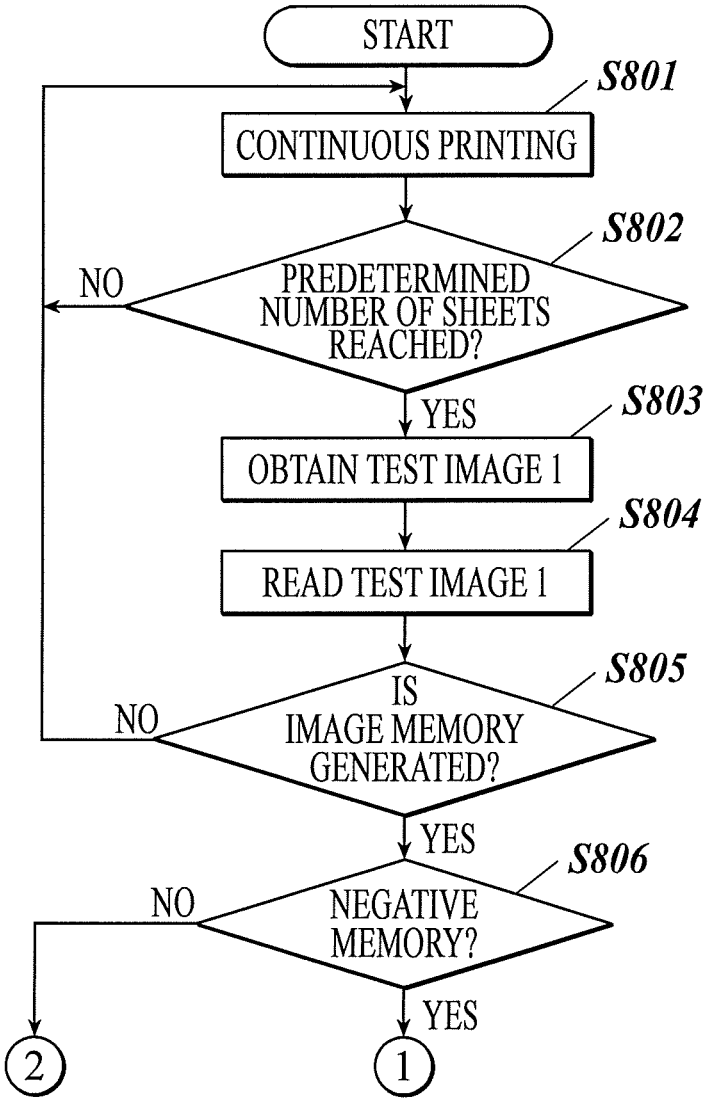
FIG. 8 is a flowchart showing an operation of the image forming apparatus.

As shown in FIG. 8, when the image forming apparatus 1 starts continuous printing (step S801), the controller 10 determines whether the number of printed sheets reaches a predetermined number of sheets (step S802). The predetermined number of sheets is a relatively large number of sheets such as 1000 sheets as described above, and the value is set in advance and stored in the storage 6. If the controller 10 determines that the number of printed sheets does not reach the predetermined number of sheets (step S802: NO), the processing returns to step S801. If the controller 10 determines that the number of printed sheets reaches the predetermined number of sheets (step S802: YES), the processing proceeds to step S803.

In step S803, the controller 10 controls the image former 4 to obtain the test image 1. The controller 10 then controls the inline sensor S to read the test image 1 (step S804).

The controller 10 determines whether the image memory is generated on the test image 1 on the basis of data of the test image 1 which was read in step S804 (step S805). That is, the image memory generated on the test image 1 is detected by comparing the density between the image of the last continuous printing and the image on the test image 1. If the controller determines that the image memory is not generated (step S805: NO), the processing returns to step S801. If the controller 10 determines that the image memory is generated (step S805: YES), the processing proceeds to step S806.

In step S806, the controller 10 determines whether the image memory generated on the test image 1 is a negative memory. That is, in a case where the density of the solid history portion of the image in the continuous printing is lower than the density of the white history portion, the image memory is determined to be a negative memory. If the controller 10 determines that the memory is the negative memory (step S806: YES), the processing proceeds to step S901 in FIG. 9. If the controller 10 determines that the memory is not the negative memory, that is, the memory is the positive memory (step S806: NO), the processing proceeds to step S1001 in FIG. 10.

The operation of the image forming apparatus 1 when the negative memory is generated will be described by using the flowchart in FIG. 9.

In step S901, the controller 10 controls the image former 4 to obtain the test image 2. The controller 10 then controls the inline sensor S to read the test image 2 (step S902).

The controller 10 determines whether the negative memory is generated on the test image 2 (step S903). If the controller 10 determines that the negative memory is not generated (step S903: NO), the controller 10 determines that the memory is the photoreceptor memory, executes the photoreceptor memory recovery mode (step S904), and ends the control. If the controller 10 determines that the negative memory is generated on the test image 2 (step S903: YES), the processing proceeds to step S905.

In step S905, the controller 10 controls the image former 4 to obtain the test image 3. The controller 10 then controls the inline sensor S to read the test image 3 (step S906).

The controller 10 determines whether the negative memory is generated on the test image 3 (step S907). If the controller 10 determines that the negative memory is generated (step S907: YES), the controller 10 determines that the memory is the lubricant memory, executes the lubricant memory recovery mode (step S908), and ends the control. If the controller 10 determines that the negative memory is not generated (step S907: NO), the controller 10 determines that the memory is the transfer memory, executes the transfer memory recovery mode (step S909), and ends the control.

The operation of the image forming apparatus 1 when the positive memory is generated will be described by using the flowchart in FIG. 10.

In step S1001, the controller 10 controls the image former 4 to obtain the test image 2. The controller 10 controls the inline sensor S to read the test image 2 (step S1002).

The controller 10 determines whether the positive memory is generated on the test image 2 (step S1003). If the controller 10 determines that the positive memory is not generated (step S1003: NO), the controller 10 determines that the memory is the accumulation-type transfer memory, executes the accumulation-type transfer memory recovery mode (step S1004), and ends the control.

If the controller 10 determines that the negative memory is generated on the test image 2 (step S1003: YES), the controller 10 determines that the memory is the charging memory, executes any of execution of charging memory recovery mode (step S1005), improvement of the charging capacity in the charging device 42 (step S1006) and display of the exchange message by the display 71 (step S1007), and ends the control. Both of the processing of steps S1006 and step S1007 may be executed.

As described above, the image forming apparatus 1 according to the embodiment includes an image former 4 and a controller 10 which functions as a density detector which detects the density of the image formed by the image former 4, a controller which controls the image former 4 to form a test image of a halftone on a sheet after continuous printing of a predetermined number of sheets, a determiner which determines whether an image defect is generated and determines a factor causing the image defect by analyzing a density of the detected test image, and a executer which executes a recovery mode which is set for each factor causing the image defect when the determiner determines that the image defect is generated.

Accordingly, according to the image forming apparatus 1 in the embodiment, since the factor causing the image defect is specified and the processing appropriate for each factor causing the image defect is executed, it is possible to recover the image defect more preferably.

The image forming apparatus 1 according to the embodiment forms a charged test image which is formed by charging the photoreceptor 41 and a test image 3 as a uncharged test image which is formed without charging the photoreceptor 41. The charged test image is classified into a test image 1 as an exposed test image which is formed by performing exposure with the exposure device 43 and a test image 2 as an unexposed test image which is formed without exposure.

Furthermore, the controller 10 as the determiner compares the density of the test image 1 with the density of a continuous printing image. In the test image 1, if the solid history portion of the continuous printing image is different from the density of the white history portion, the controller 10 determines that the image defect is generated. If the image defect is generated, the controller 10 determines the factor causing the image defect by detecting whether the difference in density occurs between the solid history portion and the white history portion in any of the test image 1, test image 2 and test image 3.

Accordingly, by generating three types of test images with and without charging and with and without exposure, the generation mechanism can be surely specified regarding the image defect for which the factor causing the defect cannot be determined at one glance. Thus, it is possible to execute the recovery mode corresponding to the mechanism.

The image forming apparatus 1 according to the embodiment includes an inline sensor S which can read the test image formed on the sheet. Accordingly, since the image density difference on the sheet can be detected accurately, it is possible to perform the analysis with high accuracy.

The image forming apparatus 1 according to the embodiment includes a sheet ejection tray E for ejecting the sheet on which the test image is printed outside the image forming apparatus 1. Accordingly, there is no concern that the test image may be mixed into the job specified by the user.

Though the embodiments according to the present invention have been specifically described, modifications can be appropriately made within the scope of the present invention as for the detailed configurations of devices forming the image forming apparatus and the detailed operations of the devices.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent Application No. 2018-027510, filed on Feb. 20, 2018 is incorporated herein by reference in its entirety.

What is claimed is:

1. An image forming apparatus, comprising:

an image former which includes an image carrier that carries a toner image to be transferred onto a sheet, a charger that charges a surface of the image carrier, an exposer that performs exposure of the surface of the image carrier and a developer that develops the toner image on the image carrier; and a hardware processor which detects a density of an image formed by the image former, controls the image former to continuously perform image formation on a predetermined number of sheets and thereafter form a plurality of types of halftone test images on a sheet, determines whether an image defect is generated and determines a factor causing the image defect by analyzing detected densities of the plurality of types of test images, executes a recovery mode which is set for each factor causing the image defect when the image defect is determined to be generated, and controls the image former to form a charged test image which is formed by the charger charging the surface of the image carrier and an uncharged test image which is formed without charging of the surface of the image carrier by the charger; and wherein the hardware processor compares a density of a halftone test image with a density of a corresponding previous halftone test image formed before creation of the halftone test image to determine whether the image defect is generated.

2. The image forming apparatus according to claim 1, wherein the hardware processor controls the image former to form, as the charged test image, an exposed test image which is formed by the exposer performing exposure and an unexposed test image which is formed without exposure by the exposer.

3. The image forming apparatus according to claim 2, wherein the hardware processor compares a density of the exposed test image with a density of a last image formed before creation of the test image, and when a density of a solid history portion in the exposed test image corresponding to a solid portion of the last image is different from a density of a white history portion in the exposed test image corresponding to a white portion of the last image, the hardware processor determines that the image defect is generated.

4. The image forming apparatus according to claim 3, wherein, when the image defect is generated, the hardware processor determines the factor causing the image defect by detecting which of the uncharged test image, the exposed test image and the unexposed test image generates a density difference between the solid history portion and the white history portion.

5. The image forming apparatus according to claim 1, comprising a test image reader which includes an image sensor that reads the test image formed on the sheet.

6. The image forming apparatus according to claim 1, comprising an ejector which ejects the sheet on which the test image is printed outside the apparatus.

7. An image forming control method in an image forming apparatus including an image former which includes an image carrier that carries a toner image to be transferred onto a sheet, a charger that charges a surface of the image carrier, an exposer that exposes the surface of the image carrier and a developer that develops the toner image on the image carrier, the method comprising:

detecting a density of an image formed by the image former;

controlling the image former to continuously perform image formation on a predetermined number of sheets and thereafter form a plurality of types of halftone test images on a sheet;

determining whether an image defect is generated by comparing a density of a halftone test image with a density of a corresponding previous halftone test image formed before creation of the halftone test image;

determining a factor causing the image defect by analyzing detected densities of the plurality of types of test images; and executing a recovery mode which is set for each factor causing the image defect when the image defect is determined to be generated.

8. A non-transitory computer readable storage medium storing a program for causing a computer of an image forming apparatus to execute a following procedure, the image forming apparatus including an image former which includes an image carrier that carries a toner image to be transferred onto a sheet, a charger that charges a surface of the image carrier, an exposer that exposes the surface of the image carrier and a developer that develops the toner image on the image carrier, the procedure comprising:

detecting a density of an image formed by the image former;

controlling the image former to continuously perform image formation on a predetermined number of sheets and thereafter form a plurality of types of halftone test images on a sheet;

determining whether an image defect is generated by comparing a density of a halftone test image with a density of a corresponding previous halftone test image formed before creation of the halftone test image;

determining a factor causing the image defect by analyzing detected densities of the plurality of types of test images; and executing a recovery mode which is set for each factor causing the image defect when the image defect is determined to be generated.

* * * * *